United States Patent [19]

Hancock

[11] Patent Number: 4,589,648

[45] Date of Patent: May 20, 1986

[54] PINCH-ACTION SUCTION CUP

[75] Inventor: Louie R. Hancock, Summerville, S.C.

[73] Assignee: Westvaco Corporation, New York, N.Y.

[21] Appl. No.: 663,715

[22] Filed: Oct. 22, 1984

[51] Int. Cl.[4] ..... B65H 3/08

[52] U.S. Cl. ..... 271/106; 271/90; 271/104; 414/121; 294/64.1

[58] Field of Search ..... 271/90, 103, 106, 107, 271/104; 414/121; 244/64.1

[56] References Cited

U.S. PATENT DOCUMENTS

| | | | |
|---|---|---|---|
| 783,206 | 2/1905 | Juengst | 271/106 |
| 1,990,334 | 2/1935 | Koppe | 271/103 |
| 2,163,274 | 6/1939 | Dixon | 271/106 |
| 2,745,665 | 5/1956 | Lambombarde | 271/106 |
| 3,053,529 | 9/1962 | Dunn | 271/107 X |
| 3,322,301 | 5/1967 | Bliss | 271/106 |
| 3,994,488 | 11/1976 | Takenaka et al. | 271/106 |
| 4,420,150 | 12/1983 | Umezawa | 271/106 |
| 4,428,793 | 1/1984 | Sato et al. | 271/106 |

FOREIGN PATENT DOCUMENTS

| | | | |
|---|---|---|---|
| 2633831 | 1/1978 | Fed. Rep. of Germany | 271/106 |

*Primary Examiner*—Bruce H. Stoner, Jr.
*Assistant Examiner*—Matthew C. Graham
*Attorney, Agent, or Firm*—W. A. Marcontell; R. L. Schmalz

[57] ABSTRACT

Quickly exchangeable inserts for sheet feeding vacuum cups are provided to accommodate an extended range of sheet permeability. Projecting form structure inserted within a feed cup bellows provides a surface discontinuity for the vacuum nozzle to retard and inhibit double sheet feeding of either highly permeable or highly impermeable paper. Single sheet feed reliability is thereby improved.

1 Claim, 8 Drawing Figures

FIG. 1
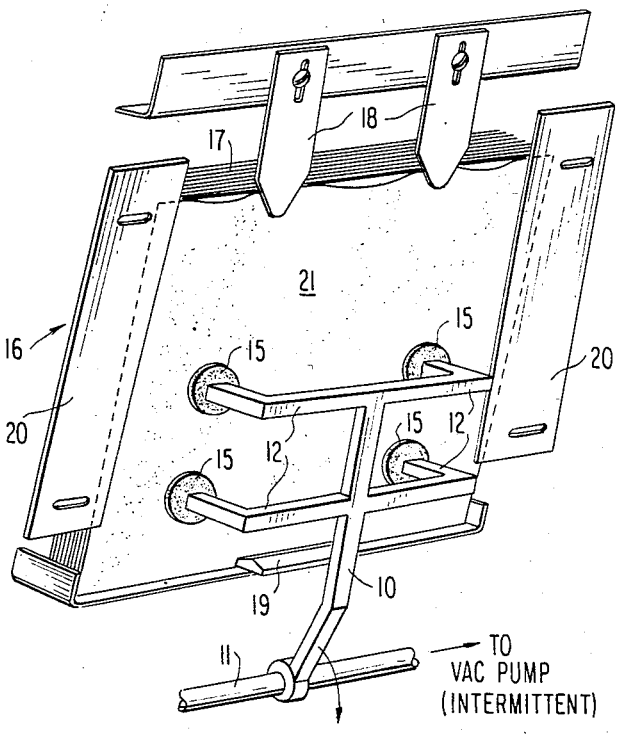
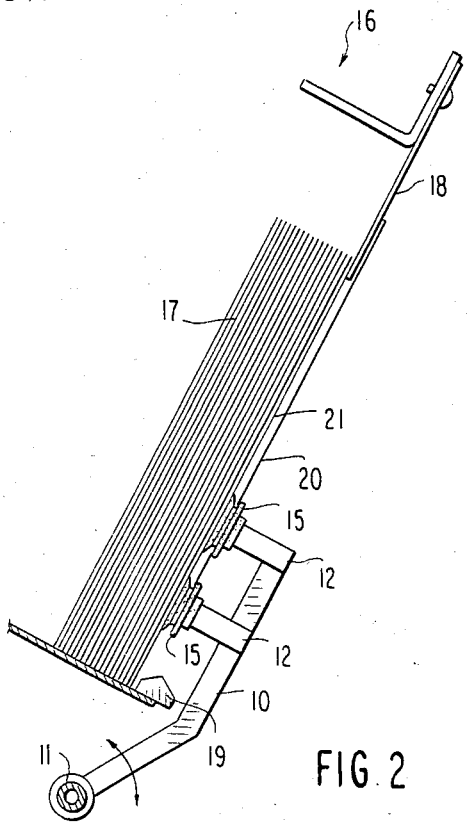
FIG. 2
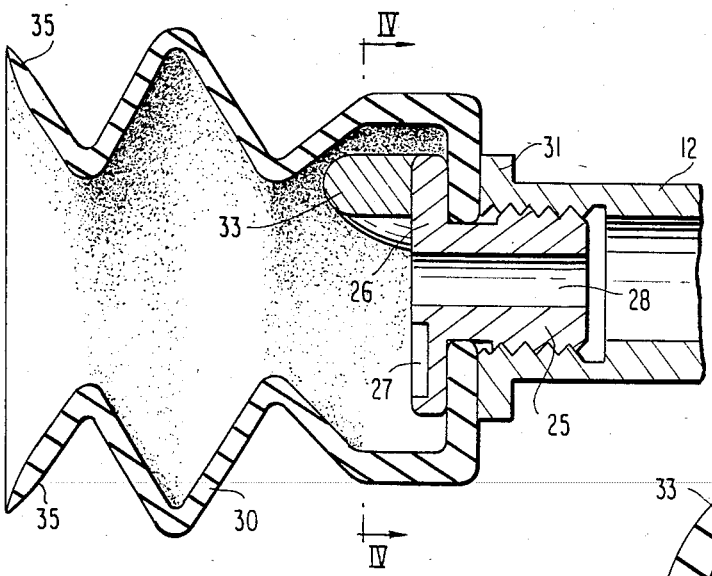
FIG. 3
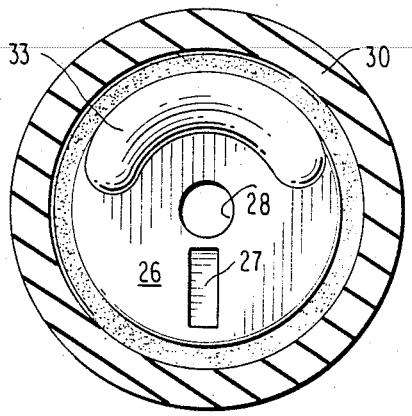
FIG. 4

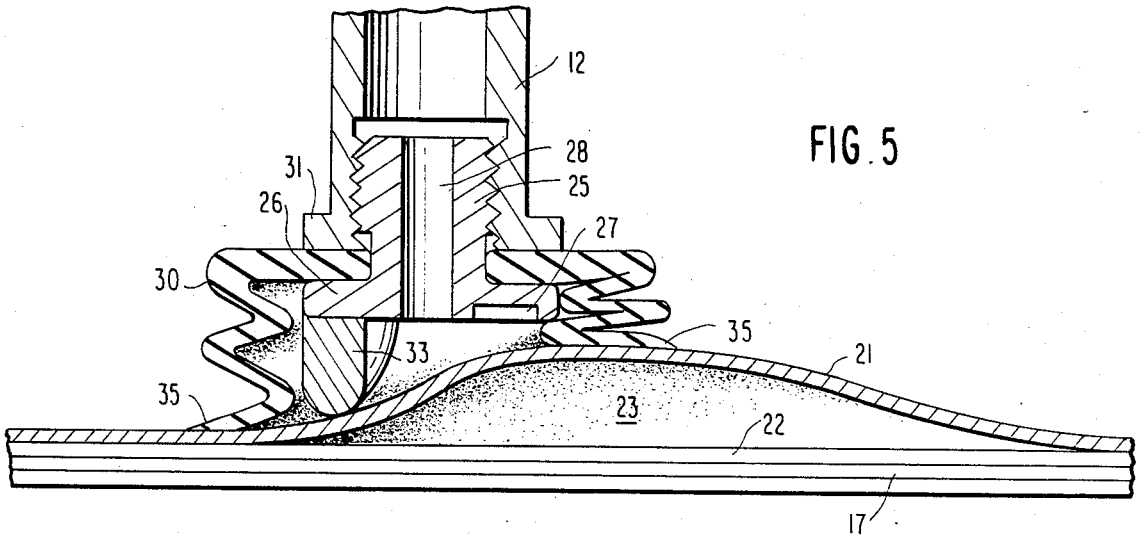
FIG. 5
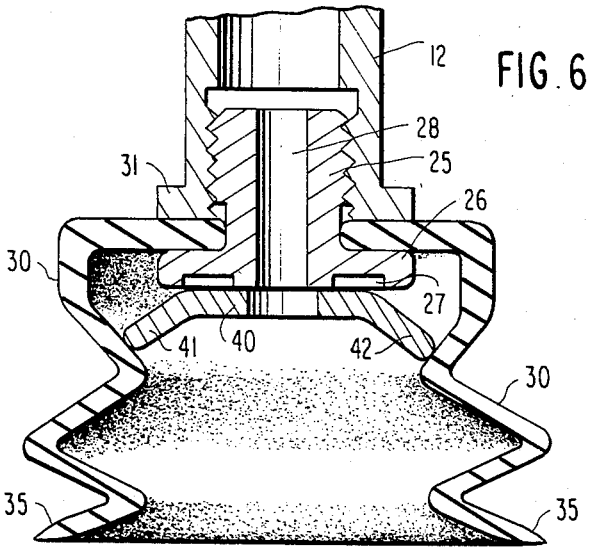
FIG. 6
FIG. 7
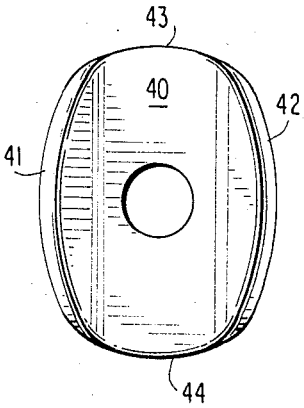
FIG. 8
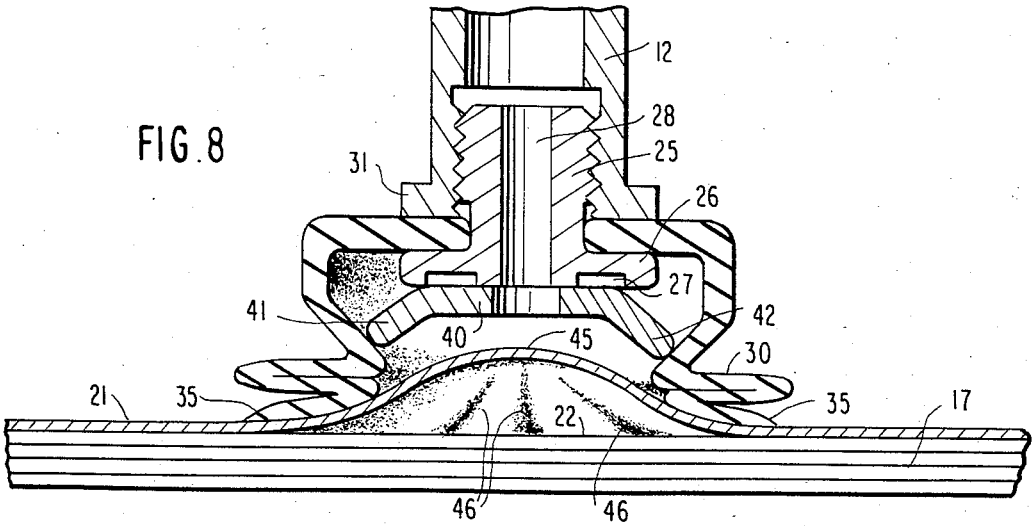

PINCH-ACTION SUCTION CUP

BACKGROUND OF THE INVENTION

Prior Art

Numerous paper sheet converting operations require a transitional feed step which entails removal of a single sheet from a magazine stack of sheets, the single sheet being placed in a serial flow production line.

One successful method of accomplishing this transitional step, mechanically, has been to grasp the single, face sheet of the magazine with suction cups secured to an articulated arm mechanism. As the cyclic movement of the arm mechanism positions the suction cups against the magazine face sheet, the cup interiors are selectively opened to a vacuum source. Secure to the suction cups, the arm continues its cycle to draw the single sheet away from the magazine and position it on the serial flow line. Synchronized release of the vacuum releases the sheet from the suction cups.

Although simple in principle and mechanical operation, the subject transitional step can be capricious and unreliable due to a characteristic trait of drawing more than one sheet from the magazine stack. This undesirable trait is normally caused by the air permeability of the sheet. Curiously, the same multiple sheet pick-up malfunction may be triggered by sheet permeability characteristics of opposite extremes. For a highly permeable sheet the powered vacuum at the cups projects through the face sheet and against the second or even third sheet behind the face sheet. In the case of impermeable sheets, resistance to atmospheric penetration through the sheet creates a vacuum behind the face sheet when an attempt is made to draw the face sheet normally from the stack.

Generally, the corrective technique for these symptomatically similar but physically different malfunctions is the same. By one of several devices, the face sheet is required by the suction cups or arm movement to slide into a shorter radius curve or pucker than the second sheet thereby breaking the vacuum between the first and second sheets.

Numerous U.S. patents have issued for mechanical devices of this sort. Representative is U.S. Pat. No. 783,206 issued Feb. 21, 1905 to C. A. Juengst which relies upon two angular bar protrusions from the face of a "sucker-head" to induce a sharply radiused curve in the face sheet of a magazine stack.

Other references of similar disclosure are those of U.S. Pat. No. 2,745, 665 issued May 15, 1956 to H. S. Labombarde and U.S. Pat. No. 3,322,301 issued May 30, 1967 to G. N. Bliss.

While it is presumed that these prior art devices are operative for the purpose disclosed, such devices are cumbersome to attach to or remove from the basic, suction cup arm structure. When the sheet feeder always handles the same paper of exactly the same mechanical characteristics and properties e.g. caliper, basis weight, permeability and stiffness, ease of accessory attachment and removal is of little consequence. However, use of identical sheet properties may be somewhat limiting as to supply sources and productivity.

Paper is a unique material in that the mechanical properties of a particular sheet are intimately related to the machine upon which the paper was laid. Although two sheets from different machines may appear identical as to caliper and surface texture, great differences may exist as to basis weight, permeability and stiffness.

A highly calendered sheet may have greater basis weight, less porosity but only slightly greater stiffness for a given caliper thickness.

To the article packaging industry, this scope of paper properties can be both harmful and helpful. If the primary package criteria are caliper, stiffness and printability, a wide range of sources may be available for supply reliability and competitive pricing. However, paper is generally valued by weight. Therefore, higher basis weight paper is more expensive per unit area than lower basis weight material.

For the dominate reasons of supply reliability and continuity, many packaging converters choose to procure their paper from several sources, slight price differentials notwithstanding. Resultantly, the converting machines must be conveniently adjustable to accommodate a running mixture of paper properties.

It is therefore, an objective of this invention to provide suction feed accessories for quickly and conveniently adjusting the permeability responsiveness of the machine.

Another object of the invention is to provide permeability adjustment accessories for sheet feeders that require no subframes or other permanent mounting structure.

SUMMARY OF THE INVENTION

These and other objects of the invention are accomplished by means of sheet surface distorting devices of such small size as to inserted within the internal perimeter of a suction cup shrouding bellows.

In one embodiment of the invention, the sheet distorting device is a knob or protrusion secured assymetrically to the flange of a bellows retaining T-nut.

Another embodiment of the invention is an annular plate such as a washer having symmetrically dihedral chord sections turned from the washer plane.

DESCRIPTION OF THE DRAWINGS

Relative to the drawings wherein like reference characters designate like or similar elements throughout the several figures:

FIG. 1 is a pictorial view of a typical suction cup sheet feeding mechanism;

FIG. 2 is an end view of the mechanism illustrated by FIG. 1;

FIG. 3 is a sectional elevation of a suction head pursuant to one embodiment of the invention;

FIG. 4 is a sectional plan of the suction head embodiment of the invention illustrated by FIG. 3 as seen along cutting plane IV—IV.

FIG. 5 is a sectional elevation of the FIG. 3 invention embodiment in operative combination with a sheet magazine.

FIG. 6 is a sectional elevation of a suction head pursuant to another embodiment of the invention.

FIG. 7 is a plan view of the invention insert element shown by FIG. 6; and, FIG. 8 is a sectional elevation of the FIG. 6 embodiment in operative combination with a sheet magazine.

DESCRIPTION OF THE PREFERRED EMBODIMENTS

A sheet feeder mechanism of a paper converting machine is generally represented by FIGS. 1 and 2 which illustrates an oscillating arm secured to an evacuated bore drive shaft 11. The outer end of arm 10 may include one or more mounting fingers 12, four in this case, to which suction heads 15 are secured. Internally, the finger 12 and arm 10 are hollow to pneumatically communicate the suction head 15 with the evalcuated bore of drive shaft 11. The drive shaft bore is connected with a vacuum pump or other evacuation means.

The sheet feeder mechanism functions cooperatively with a sheet magazine 16 which holds a stack of sheeted paper 17 by confinement tabs 18, 19 and 20. These tabs share a common plane for definition of the leading sheet plane from where the first sheet 21 is removed to be repositioned by the suction heads 15.

In operation, the drive shaft 11 is twisted to rotate the arm 10 into a position at which the suction heads 15 engage the surface of magazine face sheet 21. In timed coordination with engagement of the face sheet, the suction heads 15 are evacuated to grasp the face sheet by atmospheric pressure differential. So secured, the drive shaft 11 is twisted in an opposite direction to draw the face sheet 21 out of the magazine tab plane. The face sheet is now separated from the magazine stack 17 as a single sheet. As the shaft 11 and arm 10 continue rotation, the single sheet is moved into a different plane which may be that of a line conveyor not shown. Upon arrival at the desired position for the single sheet, the vacuum within the suction heads 15 is relieved and the sheet released.

As related previously, reliability of the aforedescribed operation is highly dependent on the sheet permeability characteristics. Highly permeable paper may transmit a significant vacuum gradient from a suction head through two or more sheets in the magazine. Consequently, the feeder mechanism will withdraw two or more sheets from the stack feeding face.

An impermeable sheet may respond to the feed mechanism in a similar manner due to vacuum pressures between the face sheet 21 and the next sheet 22 into the stack which hold the two sheets together as the first is withdrawn.

Responsive to these diverse vacuum circumstances, the present invention provides apparatus internally of the suction head 15 such as illustrated by FIGS. 3, 4 and 5. On some machines, the distal end of finger 12 is internally threaded to receive a T-nut 25 having a flanged head 26 and an axial aperture 28. Radial slots 27 are formed in the flange face to receive a screwdriver bit. The function of the T-nut 25 is to sealably secure an elastomer bellows cup 30 to the sealing flange 31 of finger 12.

To one chordal section of the T-nut flange 26 is secured a smooth surface protrusion 33 of approximately one-half inch beyond the flange face. In the present example, the protrusion 33 is a chordal section of a disc such as a washer, curved to the arc of the flange 26 perimeter and secured such as by brazing. The same principle may be applied by a round head machine screw threaded into the flange 26. Countless such equivalents are possible.

Fundamentally, the protrusion 33 creates a pressure point against the face sheet 21 when the suction head engages the stack. This pressure point is asymmetric of the vacuum force center along the axis of aperture 28. As vacuum is drawn within the perimeter of cup lips 35, the force distribution within the perimeter is unequal so as to bend the face sheet 21 sharply about the pivotal pressure point of protrusion 33. Hence that portion of the face sheet 21 diametrically opposite of the protrusion 33 is drawn closer to the face of flange 26 and must therefore slide over the surface of the second sheet 22 since the two cannot bend over the same arc radius. Such sliding permits the intrusion of an air boundary layer between the two sheets 21 and 22 and opens a void volume 23 between the two sheets under the suction head. The void volume pneumatically isolates the face sheet 21 from the second sheet 22.

Besides vacuum relief provided by sliding of one sheet on another, another important mechanism is taking place. Bending of the face sheet 21 requires a certain force. This force is, of course, provided by pressure difference on opposite sides of the sheet. Because pressure difference is high across the face sheet, the sheet is bent or deformed out-of-plane. Pressure difference is initially small in the second sheet 22; therefore, by proper selection of bending radius, the vacuum force (pressure differential) will be insufficient to deform the second sheet. Vacuum will therefore be relieved before it is built up.

That embodiment of the invention shown by FIGS. 6, 7 and 8 provides symmetric protrusions 41 and 42 from the face of T-nut flange 26 about the axis of aperture 28. These symmetric protrusions take the form of dihederal chord sections of an annular plate such as a machine washer 40 having a central aperture which aligns with the T-nut aperture 28. The outer perimeter of the washer 40 is substantially the same or less than the base section of the gabled bellows cup 30 so as to fit therewithin. Of particular note to this embodiment of FIGS. 6–8 is that no structural connection between the washer 40 and other elements of the suction head is necessary or even desirable. The accessory may be installed or removed in a matter of seconds.

Operatively, as shown by FIG. 8, the symmetric protrusion embodiment of the invention is somewhat different from the first embodiment. In the FIG. 8 case, the vacuum drawn through aperture 28 is sealed within the perimeter of bellows lip 35 to induce a pressure differential across the face sheet 21. Such pressure differential forces a localized bend in the face sheet and volumetric collapse of the bellows. As the bellows collapses axially, the dihederal protrusions 41 and 42 are first engaged to arrest the collapse in respective quadrants of the bellows perimeter. Further volumetric collapse continues axially until the other two washer quadrants 43 and 44 that are flat with the washer base are engaged. Consequently, the face sheet and bellows mouth hinges like a claw about an axis parallel with the dihederal break to "pinch" a pleat segment of the face sheet 45. Because of the deep collapse capacity of the gabled bellows 30, a pleat 45 of exaggerated proportions may be induced without loss of continuous point-to-point contact between the face sheet 21 and the bellows lip 35, i.e. the lip 35 does not stretch circumferentially. Ergo, destructive tension forces upon the face sheet 21 are minimized.

The warped geometry of the bellows cup lip 35 and pleat 45 described above is best perceived as a saddle configuration, a perspective that contributes to an understanding that the operation remains the same when the washer 40 is positioned inversely with the dihederal protrusions 41 and 42 directed away from the bellows mouth. In this case, the flat quadrants 43 and 44 would constitute the hinge inducing protrusions.

As the invention functions to gather pleat 45, the second sheet 22 is incapable of exact conformation with the pleats 45 of the face sheet 21 thereby opening channels 46 into the spacial void between sheets 21 and 22.

Any vacuum gradient through sheet 21 into sheet 22 tending to hold the two sheets together is relieved through said channels.

Central to both embodiments of the invention is the characteristic of installation speed. As production changes from one grade or source of paper to another, small differences in permeability necessarily follow. When double feeding occurs, it is not always obvious to the converting machine operator exactly which suction cup accessory, or the absence of any accessory, will restore single feed reliability. Simple and brief experimentation may be necessary.

By means of the present invention the two accessory configurations may be installed and removed in a few seconds. The FIG. 3–5 embodiment requires only a manual screwdriver for an installation tool whereas the FIGS. 6–8 embodiment requires no installation or removal tools. Which of the two accessories or neither will solve a particular double feeding problem is resolved by merely inserting one and observing the result.

Having fully disclosed my invention and the preferred embodiments thereof, those of ordinary skill in the art will perceive other configurations fully equivalent to the principles described herein. As my invention, therefore,

I claim:

1. A suction head for a paper sheet feeder mechanism comprising rigid piping means secured to articulated arm means, axial aperture means through said piping means in fluid communication with vacuum pumping means for drawing atmospheric air therethrough, rigid sealing face means terminating said piping means around said aperture means, a first portion of said sealing face means being integral with said piping means and a second portion being threadably secured to said piping means, flexible bellows means having an internal perimeter in fluid communication with said aperture means and extending axially from said sealing face means, said bellows means having an integral annular portion at one axial end thereof disposed in a plane normal to said bellows extension axis and pneumatically sealed around and between said first and second sealing face portions, another end of said bellows having flexible, annular lips surrounding an open mouth portion of said bellows other end for sealably engaging the flat plane of a sheet of paper and protrusion means integral with said sealing face second portion positioned within said bellows internal perimeter, said protrusion means having structural form to provide a substantially single abutment point laterally of said bellows extension axis within said internal perimeter for engaging the flat plane of said sheet of paper between said bellows lips and said sealing face means.

* * * * *